United States Patent [19]

Deal et al.

[11] Patent Number: 4,638,213

[45] Date of Patent: Jan. 20, 1987

[54] CRT WITH INTERNAL CONTACT STRIPE OR PATCH AND METHOD OF MAKING SAID STRIPE OR PATCH

[75] Inventors: Samuel B. Deal, Lancaster; Donald W. Bartch, Wrightsville, both of Pa.

[73] Assignee: RCA Corporation, Princeton, N.J.

[21] Appl. No.: 195,183

[22] Filed: Oct. 8, 1980

[51] Int. Cl.[4] ..... H01J 31/00

[52] U.S. Cl. ..... 313/479; 313/477 R; 313/480

[58] Field of Search ..... 313/477, 479, 480

[56] References Cited

U.S. PATENT DOCUMENTS

| | | | |
|---|---|---|---|
| 2,409,514 | 1/1945 | Pratt | 250/155 |
| 2,820,166 | 1/1953 | Pinotti | 313/479 |
| 2,950,414 | 8/1960 | Ketchpel | 313/479 X |
| 3,489,966 | 1/1970 | Bradu et al. | 313/438 |
| 3,582,978 | 6/1971 | Petersen et al. | 313/283 X |
| 3,802,757 | 4/1974 | Benda et al. | 316/14 |

FOREIGN PATENT DOCUMENTS

| | | | |
|---|---|---|---|
| 2833415 | 2/1979 | Fed. Rep. of Germany | 313/479 |

*Primary Examiner*—David K. Moore

*Attorney, Agent, or Firm*—Eugene M. Whitacre; Dennis H. Irlbeck; Vincent J. Coughlin, Jr.

[57] ABSTRACT

A cathode-ray tube comprising an evacuated envelope including a glass part and an electrically-conductive coating adhered to the glass part. The coating in the form of a patch or stripe consisting essentially of a major weight proportion of metallic silver particles, preferably in the form of flakes, and a minor weight proportion of lithium silicate binder. The electrically-conductive stripe or patch may be used to assure the electrical connection between an electrically-conductive metal body attached to and having a surface contiguous with a surface of the envelope and an electrically-conductive layer supported from that surface. The stripe or patch is applied from an aqueous slurry of silver particles and lithium silicate and is dried to a substantially water-insoluble, abrasion-resistant coating without or with high-temperature baking.

4 Claims, 3 Drawing Figures

Fig. 1
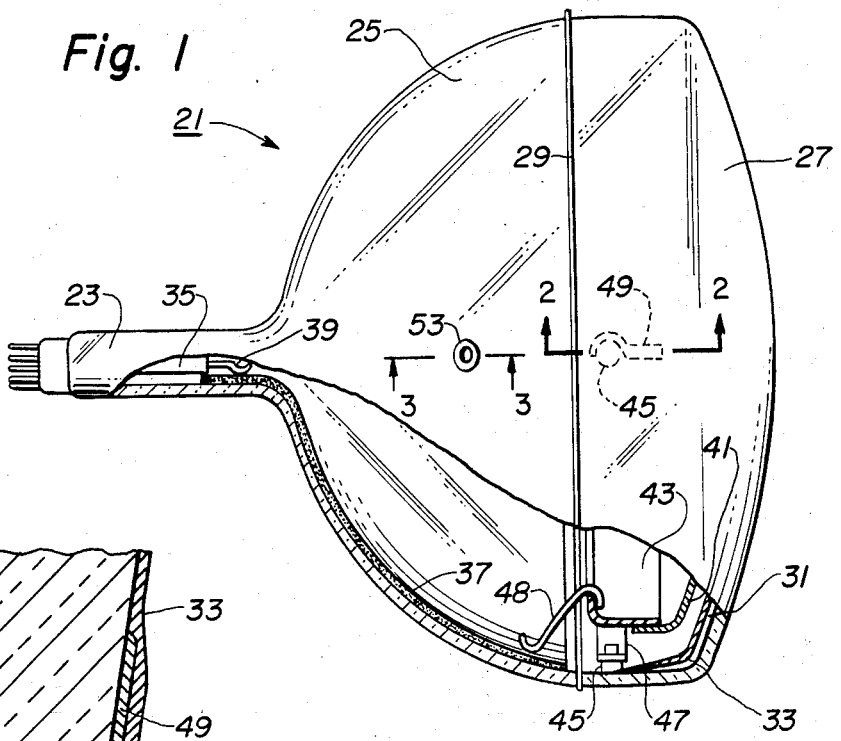
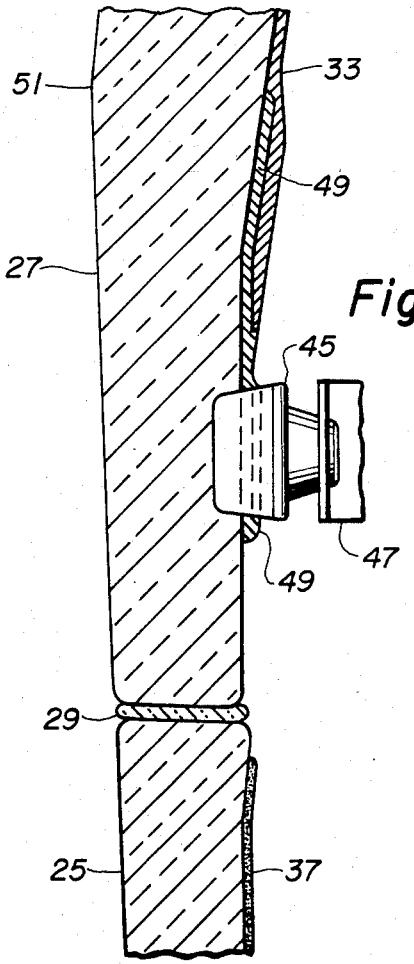
Fig. 2
Fig. 3
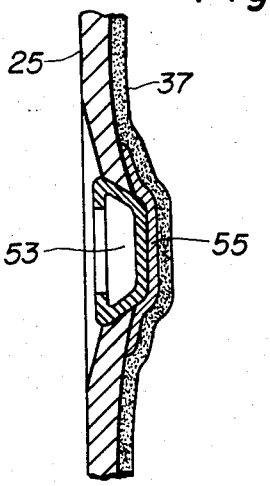

CRT WITH INTERNAL CONTACT STRIPE OR PATCH AND METHOD OF MAKING SAID STRIPE OR PATCH

BACKGROUND OF THE INVENTION

This invention relates to a novel CRT (cathode-ray tube) and particularly to a CRT having an internal electrically-conductive stripe or patch and to a method for preparing that stripe or patch in a CRT.

A CRT usually includes an evacuated glass envelope comprising a faceplate panel and a funnel. An electrically-conductive funnel coating or layer is supported on the inside wall of the funnel, and a metal anode button is sealed into and through the wall of the funnel and is in electrical contact with the funnel coating. The funnel coating is maintained at a high electrical potential that is applied at the anode button. A metallized luminescent viewing screen is supported on the inner surface of the faceplate panel of the envelope. Some CRT types include an apertured-mask assembly closely spaced from the viewing screen and supported on several metal studs imbedded in the sidewall of the panel. The metallization, which is an electrically-conductive layer, usually extends over the inner panel sidewall close to the studs. The mask assembly and the metallization of the viewing screen are also maintained at the high electrical potential.

The proper operation of the CRT requires that there be electrical continuity between the mask assembly, the metallization of the viewing screen and the anode button. When there is a discontinuity, electrical charges build up on the mask and/or the screen, causing erratic operation of the CRT. Usually the break in continuity occurs on the inside surface of the envelope adjacent the studs or the anode button, which are conductive metal bodies that are attached to the envelope. In order to assure electrical continuity, it has been the practice to apply an electrically-conductive coating in the form of a stripe or patch over a portion of at least one of the studs and the adjacent metallization, and/or over a portion of the anode button and over or under the adjacent funnel coating. This has been done by brush painting or otherwise coating a stripe or patch of a composition which, after drying and heating at about 400° C., forms a chemically-stable, electrically-conductive stripe or patch across the area of interest. Most prior stripes or patches consist essentially of graphite with an alkali silicate binder, similar in character to the funnel coating. Such prior coating compositions have several disadvantages for these applications. For example, they are relatively slow to dry; and, after they dry, they are not sufficiently insoluble in water to withstand subsequent processing with aqueous media. Thus, they are not adapted to be applied to the panel before the metallization is produced on the screen.

SUMMARY OF THE INVENTION

The novel CRT comprises an evacuated envelope including a glass part and an electrically-conductive coating adhered to said glass part. The conductive coating consists essentially of a major proportion of metallic silver particles, preferably flakes, and a minor proportion of lithium silicate binder. In one embodiment, the novel CRT comprises a glass envelope, a conductive metal body attached to the envelope, and an electrically-conductive layer supported from the interior surface of the envelope. The electrically-conductive coating is in the form of a stripe or patch contacting both the electrically-conductive layer and the metal body.

In the novel method, the conductive coating is made by applying, preferably by brushing, a stripe or patch comprising a liquid mixture of particles of silver metal and lithium silicate in an aqueous carrier. Then, the conductive coating is dried until the aqueous carrier therein is removed and the silver metal particles and the lithium silicate consolidate into a dry substantially water-insoluble coating.

In one embodiment, the viewing screen is deposited on the inner surface of the faceplate panel. Then, at least one stud and the adjacent surface of the faceplate panel are striped as described above. Then, the screen is filmed with an aqueous emulsion, metallized and baked in the usual manner. The stripe can be applied when the faceplate panel is on a screening machine just before the filming step because of its relatively rapid drying qualities and because the dry coating is resistant to leaching by aqueous media. Filming and metallizing can be done on top of the stripe because of its good mechanical strength and insolubility in water. After baking to remove the filming material, the coating has good mechanical strength, good adherence to glass and metal, good electrical conductivity and makes good electrical contact with both the stud and the metallization.

BRIEF DESCRIPTION OF THE DRAWINGS

FIG. 1 is a partially broken away longitudinal view of a novel CRT of the invention.

FIG. 2 is an enlarged fragment of the envelope of the tube shown in FIG. 1 viewed along section line 2—2.

FIG. 3 is an enlarged fragment of the envelope of the tube shown in FIG. 1 viewed along section line 3—3.

DETAILED DESCRIPTION OF THE PREFERRED EMBODIMENT

The CRT illustrated in FIG. 1 is an apertured-mask-type color television picture tube. The CRT includes an evacuated envelope designated generally by the numeral 21, which includes a neck 23 integral with a funnel 25 and a faceplate panel 27 joined to the funnel by a seal 29, preferably of devitrified glass. There is a mosaic luminescent layer 31 comprised of different-color-emitting phosphor materials on the interior surface of the faceplate 27. There is a light-reflecting metal layer or metallization 33, as of aluminum, on the luminescent layer 31. The luminescent layer 31, when suitably scanned by three electron beams from a mount assembly 35 located in the neck 23, is capable of producing a luminescent image in color, which may be viewed through the faceplate 27. The luminescent layer 31, the light-reflecting metal layer 33 and any associated structure constitute the viewing screen of the tube.

There is an electrically-conductive internal funnel coating 37 on a portion of the interior surface of the funnel 25 between the mount assembly 35 and the seal 29. Three metal fingers or snubbers 39 space the mount assembly 35 from the neck wall and connect the forward portion of the mount assembly 35 with the funnel coating 37. Closely spaced from the metal layer 33 toward the mount assembly 35 is a metal mask 41 having a multiplicity of apertures therein. The mask 41 is welded to a metal frame 43 which is supported by springs 47, which are attached to the frame 43, on studs 45 sealed in the wall of the panel 27. A metal mask-funnel connector 48, attached to the frame, contacts the funnel coating 37. Except for the features now to be discussed, the CRT is conventional in construction and operation, so that a more detailed description thereof is not necessary.

FIG. 2 shows a stud 45 and the adjacent structure in more detail. The stud 45 is imbedded in the inner sidewall of the panel 27, and an electrically-conductive coating in the form of a stripe or patch 49, according to the invention, is supported on the inner surface of the panel 27 and extends into contact half way around the stud 45 and then toward the luminescent layer 31 as far as about the mold match line 51. The metal layer 33 extends from over the luminescent layer 31 (not shown) toward the stud 45 overlapping and in contact with the stripe 49. The stripe 49 may be in other orientations if desired. The stripe 49 is constituted of flakes of silver metal and lithium silicate.

This preferred conductive coating 49 may be prepared by the following procedure. The luminescent layer 31 is deposited on the faceplate 27 by any of the known prior methods. Then, after the screen is complete and prior to filming the luminescent layer 31, a coating in the form of a stripe is applied with a brush to the inner surface of the panel 27 contacting one stud 45 and to where the metal layer 33 will be. A suitable striping composition is prepared by ball milling together

- 100 grams of silver flake with average particle size of about 2 to 5 microns (Alcan Aluminum Corp., Elizabeth, N.J.),
- 85 grams of Lithium Polysilicate 48, a solution containing about 22.1 weight percent solids (E. I. DuPont de Nemours Co., Wilmington, Del.),
- 50 grams of deionized or distilled water,
- 2.5 grams of N-22 Marasperse (Continental Can Co., New York, N.Y.) and
- 2 grams of a 2% solution of Triton DF-12 (Rohm and Haas, Phila., Pa.)

for about 17 hours using ¼" alumina balls. The milled slurry is removed from the mill and is ready for use in the novel method. After application, the stripe 49 dries rapidly into a substantially water-insoluble material that may be subjected to water-based treatments, such as filming with a water-based emulsion and rinsing with water. Also, the stripe 49 is quite adherent to the metal stud and to the adjacent glass surface. The luminescent layer 31 is now filmed with an organic polymeric film as desired and dried. Then, the panel is metallized by vaporizing aluminum metal from an evaporator at a reduced pressure (about $10^{-3}$ torr) and depositing a metal layer 33 by intercepting and condensing the vapor on the filmed luminescent layer 31, the stripe 49 and the stud 45. Because of the paths taken by aluminum metal vapor from the evaporator, there is always an area around the base of the stud 45 where aluminum is not deposited or the aluminum layer is too thin to provide adequate electrical conductivity. The stripe 49 extends and distributes the contact area with the metal layer 33. Following the metallizing step, the panel 27 is baked in air in a lehr during which time the volatile and organic matter in the luminescent layer 31 and the film are volatilized and thereby removed. The lehr reaches a maximum temperature of about 450° C. This baking step is not necessary for curing the stripe 49, nor does the baking step adversely affect the stripe. After the baking step, the panel is sealed to the funnel 25 with a devitrified glass seal 29, and subsequent tube assembly steps are carried out to complete an evacuated CRT by methods known in the art.

As shown in FIGS. 1 and 3, an anode button 53 may be striped by the novel method. The anode button 53 is a metal body sealed into the wall of the funnel with a surface contiguous with the inner surface of the funnel 25. Ordinarily, the funnel coating 37 extends over both surfaces. Sometimes the coating 37 cracks around the button 53 giving an electrical discontinuity. The problem can be overcome by applying a stripe or patch 55 over these contiguous surfaces according to the novel method before or after the funnel coating 37 is formed. As shown in FIG. 3, the stripe 55 is between the button 53 and the coating 37. The stripe produced according to the novel method may be applied by brushing or spraying.

The preferred conductive stripe is prepared from a slurry containing silver metal flakes and lithium silicate in an aqueous carrier or vehicle. Lithium silicate binder is available commercially in aqueous solutions containing about 10 to 65 weight percent solids. The weight ratio of $SiO_2/Li_2O$ in the lithium silicate solution is in the range of about 4.0 to 20.0. Suitable lithium silicates are described in U.S. Pat. No. 2,668,149 to R. K. Iler, U.S. Pat. No. 3,459,500 to M. A. Segura et al and U.S. Pat. No. 3,565,675 to R. H. Sams. The silver flakes are available commercially as a dry powder and may have average particle sizes in the range of 1 to 10 microns, and preferably 3 to 5 microns. The weight ratio of silver flakes to lithium silicate solids in the slurry is in the range of 1 to 10. An amount of water is present to bring the slurry to a desired viscosity and specific gravity of application. A dispersant and a wetting agent may also be present to aid in producing a smooth, stable slurry. The silver particles may be in random shapes, but the preferred shape is flakes, which results in greater conductivity in the ultimate stripe or patch due to the greater area of contact between adjacent flakes. Any method of mixing or dispersion may be used, but ball milling is preferred because the milled slurry stays in suspension longer. The milled slurry may be applied by brushing or spraying on the panel or funnel sidewall and touching the stud or anode button, as the case may be. The stripe or patch is dried at room temperature, or the drying may be accelerated by applying heat, as from an infrared lamp.

After the stripe or patch dries, it is substantially insoluble in most aqueous media and also is resistant to abrasion. A high-temperature baking is not required to develop these properties. The dry stripe or patch can endure high-temperature baking without degrading these properties. These properties are especially desirable in making a color television picture tube. The above-described stripe or patch may also be used under the snubbers 39 and/or the connector 48 to take advantage of the abrasion resistance of the electrically-conductive coating.

In making a CRT, the phosphors are fixed in a regular array of dots or stripes to the panel, and the panel is dried. It is at this point when it is most desirable to coat the panel sidewall up to the stud with a patch or stripe of conducting material because the sidewalls are clean and dry. The filming operation which follows employs binders and filming materials in aqueous solutions. It is therefore necessary to formulate a striping composition which, when coated and dried, is water resistant so that the applied patch or stripe will not wash off or be leached during subsequent steps, such as emulsion filming, which employ an aqueous medium.

We found at least the following advantages in using the dry electrically-conductive coatings described herein:

1. They are adherent to glass, metal and other surfaces. This permits them to be applied across bodies of different materials. Also, they can be applied over or under layers of differing materials.

2. They are resistant to baking. They exhibit high electrical conductivity and good adherence both before and after baking. Their adherence after baking is better than most graphite-and-alkali silicate internal conductive coatings.

3. They are resistant to leaching by water-based solutions. Thus, other water-based coatings can be applied on top of them. Also, they can be applied at an intermediate step during manufacturing; for example, after a CRT panel is screened and before it is aluminized.

4. They release little or no gases upon baking. Thus, they can be baked without disrupting in aluminum metal layer on top of them.

5. They are resistant to abrasion. Thus, patches of the coating may be used under spring contacts inside a CRT. For example, they may be used under the mask-funnel connector, or under a getter mounting spring mounted on an anode button, or under the snubbers on the electron-gun mount assembly.

6. They are resistant to damage by arcing. Their electrical conductivity does not decrease when they are exposed to arcing inside a CRT, as is the case with some electrically-conductive coatings, such as the graphite-and-alkali silicate coatings.

7. They are applied from aqueous slurries, which offer the best opportunities for low coat and a high degree of safety during manufacturing.

We claim:

1. In a cathode-ray tube comprising an evacuated glass envelope including a glass funnel, a neck integral with said funnel, a glass faceplate panel sealed to said funnel, a luminescent layer on the interior surface of said faceplate, an electrically-conductive layer supported from the interior glass surface of said envelope, an electrically-conductive metal body attached to said interior envelope surface, and an electrically-conductive coating contacting said interior glass surface and both said electrically-conductive layer and said metal body, the improvement wherein said electrically-conductive coating consists essentially of a major proportion of metallic silver particles and a minor proportion of lithium silicate binder.

2. The cathode-ray tube defined in claim 1 wherein said metal body is a stud sealed into said envelope, and said electrically-conductive layer is a metal layer over said luminescent layer.

3. The cathode-ray tube defined in claim 1 wherein said metal body is an anode button sealed into said funnel, and said electrically-conductive layer comprises a funnel coating on the inner surface of said funnel.

4. The cathode-ray tube defined in claim 1 wherein said conductive coating overlaps said metal body and said electrically-conductive layer overlies said conductive coating.

* * * * *